US008712307B2

(12) United States Patent
Sakakibara et al.

(10) Patent No.: US 8,712,307 B2
(45) Date of Patent: Apr. 29, 2014

(54) PRESSURE ROLLER AND FIXING DEVICE EQUIPPED WITH THE SAME

(75) Inventors: Hiroyuki Sakakibara, Yokohama (JP); Noriaki Sato, Suntou-gun (JP); Shuji Saito, Suntou-gun (JP); Hirohiko Aiba, Suntou-gun (JP); Kouichi Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 96 days.

(21) Appl. No.: 13/357,359

(22) Filed: Jan. 24, 2012

(65) Prior Publication Data

US 2012/0195657 A1 Aug. 2, 2012

(30) Foreign Application Priority Data

Jan. 27, 2011 (JP) ..... 2011-015402

(51) Int. Cl.
*G03G 15/20* (2006.01)

(52) U.S. Cl.
USPC ..... 399/339; 399/333

(58) Field of Classification Search
USPC ..... 399/333, 339
See application file for complete search history.

(56) References Cited

U.S. PATENT DOCUMENTS

| | | | | | |
|---|---|---|---|---|---|
| 5,331,385 | A * | 7/1994 | Ohtsuka et al. | ..... | 399/331 |
| 5,782,730 | A | 7/1998 | Kawasaki | | |
| 2005/0226661 | A1 | 10/2005 | Ohmura | | |
| 2007/0231027 | A1 * | 10/2007 | Kamei et al. | ..... | 399/329 |

FOREIGN PATENT DOCUMENTS

| | | | | | |
|---|---|---|---|---|---|
| CN | 101051208 | A | | 10/2007 | |
| CN | 101631830 | A | | 1/2010 | |
| JP | 04-019687 | A | | 1/1992 | |
| JP | 3102317 | B2 | | 10/2000 | |
| JP | 2002-258653 | A | | 9/2002 | |
| JP | 2004-086202 | A | | 3/2004 | |
| JP | 2007-63569 | A | | 3/2007 | |
| JP | 2008-222942 | A | | 9/2008 | |
| JP | 2008222942 | A | * | 9/2008 | ..... C08K 5/42 |

* cited by examiner

*Primary Examiner* — Clayton E Laballe
*Assistant Examiner* — Jas Sanghera
(74) *Attorney, Agent, or Firm* — Canon U.S.A., Inc., IP Division

(57) ABSTRACT

A pressure roller for use in a fixing device includes a core metal, an elastic layer, and a releasing layer. The releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer. The fluorine resin contains at least one polymer selected from among polyvinylidene fluoride, polyacrylonitrile, and polymethyl methacrylate, and monomer electrolyte.

23 Claims, 2 Drawing Sheets

PRESSURE ROLLER AND FIXING DEVICE EQUIPPED WITH THE SAME

BACKGROUND OF THE INVENTION

1. Field of the Invention

The present invention relates to a pressure roller suitable for use in a fixing device mounted in an image forming apparatus, such as an electrophotographic copying machine and an electrophotographic printer, and a fixing device including the pressure roller.

2. Description of the Related Art

As fixing devices mounted in electrophotographic printers or electrophotographic copying machines, there has been known a heat roller-type fixing device including a halogen heater, a fixing roller heated by the halogen heater, and a pressure roller brought into contact with the fixing roller to form a nip portion.

Additionally, there has been known a film heating-type fixing device including a heater having a heat generating resistor formed on a substrate made of ceramics, a fixing film moving on the heater while being brought into contact with the heater, and a pressure roller forming a nip portion together with the heater via the fixing film.

Each of the heat roller-type fixing device and the film heating-type fixing device is configured to heat and fix a toner image onto a recording material carrying an unfixed toner image thereon while the recording material is pinched and transported at the nip portion.

A releasing layer is generally provided on a surface layer of the fixing roller or fixing film and a surface layer of the pressure roller, which are used in these types, to prevent the toner from adhering thereto. A fluorine resin can be used as the releasing layer.

However, since the fluorine resin is a high electrical insulation material, the fluorine resin has properties in which it is easily electrically charged and static electricity is hardly escaped therefrom. For this reason, if the recording material with the unfixed toner image is transported to the nip portion of the fixing device, an electrostatic offset image (hereinafter, referred to as electrostatic offset) is likely to occur, in which the unfixed toner electrically adheres to a surface of the fixing roller or fixing film and is then fixed to the recording material when the fixing roller or fixing film revolves.

Accordingly, a method of dispersing a charge control agent onto the fluorine resin or a method of applying a voltage to the pressure roller has been proposed to prevent the fluorine resin of the releasing layer from being electrically charged.

For example, Japanese Patent Application Laid-Open No. 04-19687 discusses a fixing device including a fixing member having a heat generating element therein, and a pressure roller placed opposite to the fixing member in a freely rotating manner, in which the pressure roller has an electrically conductive core metal, an elastic layer formed on the core metal, and a surface layer of an electrically conductive PFA tube formed on the elastic layer.

Furthermore, Japanese Patent No. 3,102,317 discusses a pressure roller and a fixing device characterized in that the pressure roller includes an insulating surface layer formed on an outermost layer of the pressure roller, and at least one low-resistance layer formed inside the insulating surface layer and applied by a voltage, and the lateral surfaces of both ends of the pressure roller are coated with insulating material.

In addition, Japanese Patent Application Laid-Open No. 2008-222942 discusses a fluorine resin composition containing a fluorine resin, a fluoroalkylsulfonate, and no conductive particle, which is applied to a copying machine or a printer.

However, the configurations of the related art have the following issues from the viewpoint of electrostatic offset and toner stain.

First, the electrostatic offset and the toner stain will now be described herein. When a surface potential of the pressure roller is excessively increased by frictional electrification when an electric field to attract the toner to the surface of the fixing film or fixing roller from the recording material is generated, and thus the electrostatic offset occurs on the recording material. Therefore, an offset image is continuously produced on the whole image. Meanwhile, the toner stain is the one in which the offset toner adheres to and accumulates on the surface layer of the pressure roller. A lump of toner adheres to the underside of the recording material at any timing, which causes an image defect.

In the case of the related art where the conductive PFA tube is provided as the surface layer of the pressure roller, the toner stain easily develops on the pressure roller. The conductive PFA tube is made by adding carbon to insulating PFA to produce conductivity. As compared with the insulating PFA tube with no conductive material, its electrostatic offset is superior, while its releasing property of the toner is inferior.

If the content of the carbon is reduced, the releasing property is improved, but the electrostatic offset is decreased. Accordingly, in the carbon-added conductive PFA tube, the electrostatic offset and the stain of the pressure roller are in a trade-off relationship.

In addition, in the configuration in which the insulating PFA tube is used on the surface layer of the pressure roller, and at least one low-resistance layer is formed inside the insulating surface layer and applied by a voltage, the applied voltage needs to be very high. The reason is that the surface layer of the pressure roller is frictionally charged by feeding paper, and thus it is necessary to supplement the surface potential of the pressure roller, which is strongly shifted to negative polarity, by applying a voltage. In this instance, leak caused by partial electrical breakdown or the like is likely to occur on the surface of the PFA tube. Furthermore, although the electrostatic offset and the stain of the pressure roller were examined by applying a voltage while the content of the carbon was gradually reduced, an improvement in the electrostatic offset is not compatible with a reduction of the stain of the pressure roller.

Meanwhile, a tube including fluoroalkylsulfonate contained in the fluorine resin (PFA) has a tendency to improve the frictional electrification property with paper, as compared with the insulating PFA tube, but does not exhibit an effect on the electrostatic offset in the case of paper that easily causes the pressure roller to be charged.

SUMMARY OF THE INVENTION

The present invention is directed to a pressure roller and a fixing device, in which an improvement in electrostatic offset is compatible with a reduction of a toner stain of the pressure roller.

According to an aspect of the present invention, a pressure roller for use in a fixing device includes a core metal, an elastic layer, and a releasing layer, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing at least one type of polymer selected from among polyvinylidene fluoride, polyacrylonitrile, and polymethyl methacrylate, and monomer electrolyte.

According to another aspect of the present invention, a fixing device includes a heating member, and a pressure roller including a core metal, an elastic layer, and a releasing layer, and forming, together with the heating member, a nip portion configured to heat, while pinching and transporting, a recording material carrying an image, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing at least one type of polymer selected from among polyvinylidene fluoride, polyacrylonitrile, and polymethyl methacrylate, and monomer electrolyte.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

(1) Fixing Device 6

Figure 1:
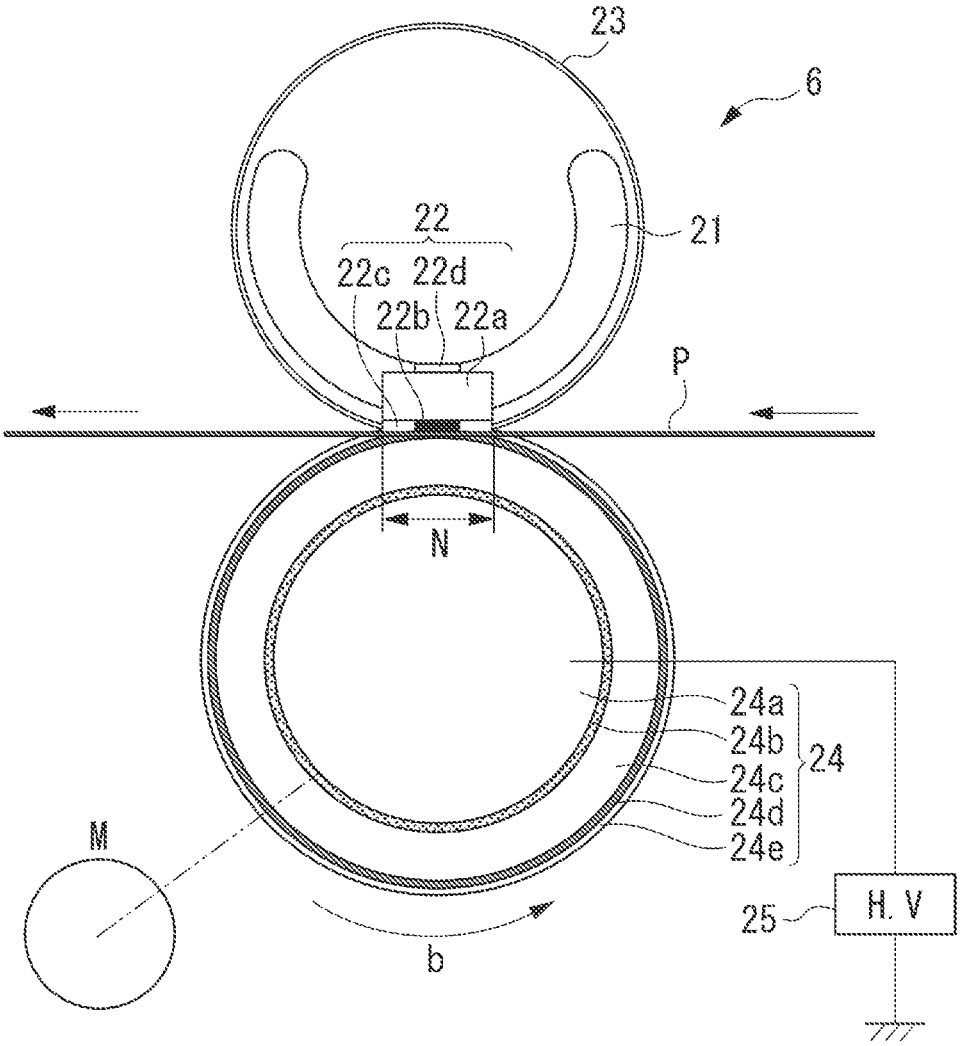
FIG. 1 is a schematic diagram illustrating a fixing device according to an exemplary embodiment of the present invention.

The configuration of an image forming apparatus equipped with a fixing device is known in the art, and thus its description will be omitted. FIG. 1 is a schematic diagram illustrating a fixing device 6 according to an exemplary embodiment of the present invention. A film guide member (stay) 21 has a transverse section formed in a substantially semi-circular arc and gutter shape and is transversely long in a longitudinal direction corresponding to a direction perpendicular to the drawing. A transversely long heater 22 is received and held in a groove substantially formed at the center of the lower surface of the film guide member 21 in a longitudinal direction. An endless belt-type heat-resistant belt (fixing film) 23 is loosely fitted to the outside of the film guide member 21 attached with the heater 22. Components 21 to 23 configure a heating member according to the present exemplary embodiment. A pressure roller 24 is brought into press-contact with the lower surface of the heater 22, with the heat-resistant belt 23 being interposed between the heater 22 and the pressure roller 24.

A nip portion N is formed by the heater 22 and the pressure roller 24, with the heat-resistant belt 23 being interposed between the heater 22 and the pressure roller 24. The pressure roller 24 is rotated by a driving source M. The film guide member 21 is a molding product made of a heat-resistant resin, such as polyphenylene sulfide (PPS) or liquid crystal polymer.

The heater 22 is a ceramic heater having low thermal capacity. Specifically, the heater 22 includes a heater substrate 22*a*, such as alumina or AlN, formed in a transversely long thin plate shape, a resistance heat generating element 22*b* of a linear shape or a narrow band shape, such as Ag/Pd, formed on a surface (film sliding surface) of the substrate in a longitudinal direction, a thin surface protection layer 22*c*, such as glass layer, and a temperature measuring element 22*d* such as a thermistor provided on the opposite surface of the heater substrate 22*a*. The temperature of the ceramic heater 22 promptly increases upon supplying power to the resistance heat generating element 22*b*, and the heater 22 is controlled at a predetermined fixing temperature (target temperature to be controlled) by a power control unit including the temperature measuring element 22*d*.

In order to improve quick start performance of the fixing device by decreasing the thermal capacity of the heat-resistant belt 23, the heat-resistant belt 23 is configured as a composite-layered film having a film thickness of 400 μm or less in total, desirably, in the range of 50 μm to 300 μm inclusive.

The base layer of the heat-resistant belt 23 is formed from a heat-resistant resin such as polyimide, polyamideimide or PEEK, or a metal having heat resistance and high thermal conductivity, such as stainless steel (SUS), aluminum (Al), nickel (Ni), titanium (Ti), or zinc (Zn), either singly or as a composite. An elastic layer for ameliorating the toner fixing performance may also be formed on the base layer, and a silicone rubber, a fluorine rubber and the like, to which a thermally conductive filler, a reinforcing material and the like have been added, are suitably used.

The main polymer of the heat-resistant belt releasing layer is constituted of a fluorine resin, and specific examples include the following: homopolymers such as polyvinylidene fluoride and polyvinyl fluoride; ethylene-tetrafluoroethylene copolymer (hereinafter, abbreviated to ETFE), ethylene-trifluorochloroethylene copolymer, tetrafluoroethylene-perfluoroalkyl vinyl ether copolymer (hereinafter, abbreviated to PFA), and tetrafluoroethylene-hexafluoropropylene copolymer. Among them, PFA and ETFE are more desirable in view of moldability, heat resistance, flex resistance, and the like. The polymers can be used singly, or in combination of two or more kinds. It is also useful that the releasing layer contains a conductive member such as carbon black or an ion conductive substance as necessary.

The pressure roller 24 includes a core metal 24*a* made of, for example, iron or aluminum material, a rubber elastic layer 24*c*, adhesive layers 24*b* and 24*d*, and a releasing layer 24*e*, the above layers being able to be obtained by using the material and the fabricating method described in detail in Paragraph (2) below.

A voltage applying circuit 25 for electrically holding the toner on the recording material P at the fixing nip portion N is electrically connected to the core metal 24*a* of the pressure roller 24. The voltage applying circuit 25 may be connected to the elastic layer 24*c* or the adhesive layers 24*b* and 24*d*. In addition, the voltage applying circuit may be connected to the pressure roller, or may be connected to the heating member. Alternatively, the voltage applying circuit may be separately connected to the pressure roller and the heating member.

The heat-resistant belt 23 is rotated by the rotation of the pressure roller 24 when the pressure roller 24 rotates in a counterclockwise direction indicated by the arrow b during at least the image forming process. That is, when the pressure roller 24 is rotationally driven, a rotary force acts on the heat-resistant belt 23 at the fixing nip portion N in terms of a friction force between the outer peripheral surface of the pressure roller 24 and the outer peripheral surface of the heat-resistant belt 23. When the heat-resistant belt 23 rotates, the inner surface of the heating resistant belt 23 slides while being in close contact with the lower surface which is the surface of the heater 22 at the nip portion N. In this instance, in order to reduce sliding resistance between the inner surface of the heat-resistant belt 23 and the lower surface of the heater 22, lubricant such as thermal resistant grease may be interposed therebetween.

While the recording material P is transported and nipped at the fixing nip portion N, the toner image carried on the recording material P is heated and fixed onto the recording material P. The recording material P passing through the nip portion N is separated from the outer surface of the heat-resistant belt 23, and then is transported.

Since the film heating-type heat-fixing device 6 according to the present exemplary embodiment includes the heater 22 which has the low thermal capacity and in which a temperature promptly increases, it is possible to remarkably reduce a time for the heater 22 arriving at the predetermined temperature. Since the temperature of the heater can be easily increased up to the high-temperature from a room temperature, and it is not necessary to control the temperature of the fixing device in a standby state during a non-printing process, thereby saving power. Additionally, a tension is not substantially applied to the rotating heat-resistant belt 23 at a portion other than the fixing nip portion N, and only a flange member is provided as a film movement regulator to just support the end portion of the heat-resistant belt 23.

(2) Pressure Roller 24

Hereinafter, a material and a method for forming the pressure roller 24 in the above-described heating fixing device 6 will now be described in detail.

2-1) Layer Configuration of Pressure Roller 24

The pressure roller 24 according to the present exemplary embodiment is a pressure roller in which at least the following layers are laminated around the outer periphery of the core metal 24*a*.

1: An elastic layer 24*c* formed of a flexible and heat-resistant material, which is represented by a silicone rubber.

2: A releasing layer 24*e* formed of at least one fluorine resin selected from among tetrafluoroethylene-perfluoroalkyl vinyl ether copolymer (PFA), ethylene-tetrafluoroethylene copolymer (ETFE), and tetrafluoroethylene-hexafluoropropylene copolymer (FEP), the fluorine resin containing at least one polymer selected from among polyvinylidene fluoride, polyacrylonitrile, and polymethyl methacrylate, and monomer electrolyte. If necessary, the following layers may also be added.

3: An adhesive layer 24*b* for causing the core metal 24*a* and the elastic layer 24*c* to adhere to each other.

4: An adhesive layer 24*d* for causing the elastic layer 24*c* and the releasing layer 24*e* to adhere to each other.

In addition, increasing the number of layers is acceptable within the range in which it does not interfere with the functions of the present exemplary embodiment.

2-1-1) Core Metal 24*a*

A core metal made of iron or aluminum is suitably used, and the core metal may also be subjected in advance to activation of the surface with sandblasting or the like, and then degreased with methylene chloride, a hydrocarbon cleaner, an aqueous cleaner or the like.

2-1-2) Adhesive Layer 24*b*

When a primer for peroxide vulcanized-type silicone rubbers, or a primer for addition type silicone rubbers is used, the core metal 24*a* and the elastic layer 24*c* can firmly adhere to each other. If necessary, the adhesive layer may be used after sintering at 120° C. to 170° C. for about 30 minutes to 1 hour.

2-1-3) Elastic Layer 24*c*

The elastic layer 24*c* is a layer for forming the fixing nip portion N, as described above, and it is desirable that a solid rubber elastic layer or a foam rubber layer is used as the elastic layer. The thickness of the elastic layer 24*c* used in the pressure roller 24 is not particularly limited so long as the thickness is enough for forming the fixing nip portion N having a desired width, but it is desirable that the thickness is in the range of 2 to 10 mm.

As the main polymer of the elastic layer 24*c*, any of the following polymers can be suitably used. For example, a high temperature vulcanized-type silicone rubber (HTV), an addition reaction cured type silicone rubber (LTV), a condensation reaction cured type silicone rubber (RTV), a fluorine rubber, and mixtures thereof may be used. Specific examples that can be used include silicone rubbers such as a dimethyl silicone rubber, a fluorosilicone rubber, a methyl phenyl silicone rubber, and a vinyl silicone rubber; and fluorine rubbers such as a vinylidene fluoride rubber, a tetrafluoroethylene-propylene rubber, a tetrafluoroethylene-perfluoromethyl vinyl ether rubber, a fluorine-containing phosphagen-based rubber, and a fluoropolyether. These main polymers can be used singly or in combination of two or more kinds. Carbon black, a reinforcing filler material such as wet silica or fumed silica, and an extending filler material such as calcium carbonate or powdered quartz may be contained in the main polymers described above.

Furthermore, in order to impart electrical conductivity, the volume intrinsic resistance value may be lowered by using various conductivity imparting agents as filler materials. Examples of these conductivity imparting agents include conductive carbon black such as acetylene black or Ketjen black; graphite; powdered metals such as silver, copper, and nickel; conductive zinc oxide, conductive calcium carbonate, and carbon fibers, but carbon black is generally used.

Furthermore, in the case of making the elastic layer 24*c* into a foam layer, a hollow spherical filler material such as a glass balloon or a silica balloon may be dispersed in the main polymer described above.

A predetermined amount of a desired filler material may be contained and dispersed in the main polymer, a elastic layer may be formed by coating the dispersion on the adhesive layer 24*b* on the core metal 24*a* by a known method such as a mold casting method or a ring coating method, and the elastic layer may be cured by heating, and then released.

In addition, a technique may be used in which after the fluorine resin tube which is the releasing layer 24*e* is set in a molding die in advance, and in the inside of the molding die, the core metal 24*a* is placed to be coaxial with the center of the molding die, the main polymer, in which a desired filler of a predetermined amount is combined and dispersed, is casted between the core metal 24*a* and the fluorine resin tube. In this instance, the elastic layer 24*c* and the releasing layer 24*e* can maintain a good adhesive property by casting the main polymer after the inner surface of the fluorine resin tube is applied with primer.

2-1-4) Adhesive Layer 24*d*

As the adhesive layer 24*d*, it is acceptable to use any one of a silicone rubber adhesive type and a silicon primer type. For the silicone rubber adhesive type, it is possible to cause the elastic layer 24*c* and the releasing layer 24*e* to strongly adhere to each other by using the following material.

Type A: Addition-type silicone rubber adhesive which is commercially available.

Type B: Composition configured by combining addition-type silicone rubber composition having no adhesive impregnation agent with an adhesive impregnation agent.

Various conductivity imparting agents or antistatic agents may also be used as fillers in the silicone rubber adhesive. Examples of the conductivity imparting agents include conductive carbon black, graphite, powdered metal such as silver, copper, and nickel, conductive zinc oxide, conductive calcium carbonate, and carbon fibers, but conductive carbon black is generally used.

Furthermore, a polyether system or an ion conductive antistatic agent may be used as the antistatic agent; however, in view of heat resistance, an ion conductive antistatic agent is desirable, and a lithium salt or a potassium salt is suitable.

2-1-5) Releasing Layer 24*e*

The releasing layer 24*e* provided on the pressure roller is characterized in that the releasing property on the toner maintains the property of the pure fluorine resin, and its electric charge decay performance is high. The reason is that an additive contained in the fluorine resin (at least any one of PFA, ETFE, and FEP) of the main binder is present in small amounts, and thus the charge decay performance is high.

First, the releasing layer 24*e* of the pressure roller contains at least one polymer selected from among polyvinylidene fluoride (PVDF), polyacrylonitrile (PAN), and polymethyl methacrylate (PMMA), and a monomer electrolyte in the fluorine resin of the main binder.

Specific examples of the fluorine resin of the main binder include ethylene-tetrafluoroethylene copolymer (ETFE), tetrafluoroethylene-perfluoroalkyl vinyl ether copolymer (PFA), and tetrafluoroethylene-hexafluoropropylene copolymer (FEP). Among them, PFA and ETFE are more desirable in view of moldability, heat resistance, and flex resistance.

The polymer that is contained in the fluorine resin (PFA, ETFE or FEP) of the main binder is desirably polyvinylidene fluoride (PVDF), polyacrylonitrile (PAN), or polymethyl methacrylate (PMMA).

The following effects are achieved by adding the polymer. In the fluorine resin (PFA, ETFE, or FEP) which is the basic binder of the releasing layer 24*e*, since the fluorine resin has a high crystalline property, it is not enough to ensure ion mobility of detached electrolyte only by containing exclusive monomer electrolyte, which will be described below.

It is estimated that the ion can move in the polymer by adding a small amount of electrolyte contained in the fluorine resin (PFA, ETFE, or FEP) as polymer electrolyte (monomer electrolyte+polymer), so the ion mobility of the electrolyte is significantly increased, without losing the inherent properties of the fluorine resin. As the result of extensive studies about the selected polymer, a desirable one has been found.

Among the polymers described above, from the viewpoints of affinity with the solvent, thermal and chemical stability, and compatibility with fluorine resins (PFA, ETFE, and FEP), polyvinylidene fluoride (PVDF) is desirable. The amount of addition of polyvinylidene (PVDF), polyacrylonitrile (PAN) or polymethyl methacrylate (PMMA) to the fluorine resin is desirably in the range of 0.05 parts to 5 parts inclusive relative to 100 parts of the fluorine resin. Here, the amount of addition is only the amount of the raw material, which does not include the amount of the solvent. If the amount of addition is 0.05 parts or less, the charge reducing effect is insufficient, and if the amount of addition is 5 parts or more, processability is deteriorated. The polyvinylidene fluoride (PVDF), polyacrylonitrile (PAN), and polymethyl methacrylate (PMMA) may be used singly, or may be used as mixtures.

It is desirable that the monomer electrolyte to be contained in the fluorine resin (PFA, ETFE or FEP) of the main binder is a fluorine-based surfactant, from the viewpoint of high heat resistance. Among fluorine-based surfactants, the following substances selected from among sulfonic acids, disulfonic acids, sulfonimides, and sulfonamides of fluoroalkylsulfonic acid derivatives are suitably used.

Examples of the sulfonic acids include lithium trifluoromethanesulfonate, potassium trifluoromethanesulfonate, sodium trifluoromethanesulfonate, ammonium trifluoromethanesulfonate, potassium pentafluoroethanesulfonate, lithium pentafluoroethanesulfonate, sodium pentafluoroethanesulfonate, ammonium pentafluoroethanesulfonate, potassium heptafluoropropanesulfonate, lithium heptafluoropropanesulfonate, sodium heptafluoropropanesulfonate, ammonium heptafluoropropanesulfonate, potassium nonafluorobutanesulfonate, lithium nanofluorobutanesulfonate, sodium nonafluorobutanesulfonate, ammonium nonafluorobutanesulfonate, potassium perfluorobutanesulfonate, and lithium perfluorobutanesulfonate.

Examples of the disulfonic acids include 1,1,2,2,3,3-hexafluoropropane-1,3-disulfonic acid, 1,1,2,2,3,3-hexafluoropropane-1,3-disulfonic acid dipotassium salt, 1,1,2,2,3,3-hexafluoropropane-1,3-disulfonic acid disodium salt, 1,1,2,2,3,3-hexafluoropropane-1,3-disulfonic acid diammonium salt, and 1,1,2,2,3,3-hexafluoropropane-1,3-disulfonic acid dilithium salt.

Examples of the sulfonimides include bis(heptafluoropropanesulfonyl)imide potassium salt, bis(heptafluoropropanesulfonyl)imide lithium salt, bis(heptafluoropropanesulfonyl)imide sodium salt, bis(heptafluoropropanesulfonyl)imide ammonium salt, bis(nonafluorobutanesulfonyl)imide potassium salt, bis(nonafluorobutanesulfonyl)imide sodium salt, bis(nonafluorobutanesulfonyl)imide ammonium salt, bis(nonafluorobutanesulfonyl)imide lithium salt, cyclohexafluoropropane-1,3-bis(sulfonyl)imide potassium salt, cyclohexafluoropropane-1,3-bis(sulfonyl)imide sodium salt, cyclohexafluoropropane-1,3-bis(sulfonyl)imide ammonium salt, and cyclohexafluoropropane-1,3-bis(sulfonyl)imide lithium salt.

Examples of the sulfonamides include trifluoromethanesulfonamide potassium salt, pentafluoroethanesulfonamide, pentafluoroethanesulfonamide potassium salt, heptafluoropropanesulfonamide, heptafluoropropanesulfonamide potassium salt, and nonafluorobutanesulfonamide potassium salt.

The fluoroalkylsulfonic acid derivatives have very high decomposition temperatures and exhibit high ion conductivity, and therefore, the derivatives are suitable to be contained in the fluorine resins. The amount of addition of the fluoroalkylsulfonic acid derivatives into the fluorine resin (PFA, ETFE or FEP) is desirably in the range of 0.05 parts to 5 parts inclusive relative to 100 parts of the fluorine resin. Here, the amount of addition is the amount of the raw material only, which does not include the amount of the solvent. If the amount of addition is 0.05 parts or less, the charge reducing effect is insufficient, and if the amount of addition is 5 parts or more, processability is deteriorated.

The incorporation of the fluorine resin (PFA, ETFE or FEP) may be carried out by mixing the at least one polymer selected from among polyvinylidene fluoride (PVDF), polyacrylonitrile (PAN) and polymethyl methacrylate (PMMA), and the monomer electrolyte into the fluorine resin (PFA, ETFE or FEP), and melting the mixture.

It is desirable to manufacture the releasing layer in the tube shape by using the material through a forming method known in the art, for example, an extrusion method, from the viewpoint of superior strength and durability.

The fluorine resin tube of the releasing layer 24*e* may be coated after the adhesive layer 24*d* is applied thereon, or may be formed by using the above-described technique in which the fluorine resin tube is set by the molding die in advance.

The releasing layer 24*e* provided on the pressure roller 24 is characterized in that the releasing property on the toner maintains the property of the pure fluorine resin, and its electric charge decay performance is high. Furthermore, the pressure roller 24 can have more superior charge decay performance by lowering the resistance of the elastic layer 24*c* and the adhesive layers 24*b* and 24*d* of the pressure roller 24 or by giving antistatic performance to the elastic layer 24*c* and the adhesive layers 24*b* and 24*d* of the pressure roller 24.

In addition, it can further increase the effect of suppressing the electrostatic offset by applying the voltage to the pressure roller 24 from the voltage applying unit. The voltage applying unit may be provided only to the heating member or may be provided to both the heating member and the pressure roller.

In addition to the film heating type according to the present exemplary embodiment, the same effect may be achieved, in the other heating types such as a heat roller type and the like, by the configuration including the pressure roller and the voltage applying unit, which will be described below.

Hereinafter, the present invention will now be described in detail by use of Examples.

Example 1

First, primer for addition cure-type silicone rubber (trade name: DY39-051 A&B, "Liquid A" and "Liquid B" manufactured by Dow Corning Toray Co., Ltd.; are mixed together at a proportion of 1:1) is spray-coated as the adhesive layer 24*b* on the outer periphery of the core metal 24*a* made of iron having Φ23, of which the surface is subjected to sand blast, and then is sintered at a temperature of 150° C. for 30 minutes.

Next, in a molding die having a diameter of 30 mm, in which the core metal 24*a* made of iron is equipped to the center portion thereof, 50 parts of Liquid A (main component liquid) and 50 parts of Liquid B (curing agent) of addition cure-type conductive silicone rubber materials DY35-1349SC A&B (products having volume resistivity of $10^6$ Ω·cm) manufactured by Dow Corning Toray Co., Ltd. are casted, and then are primarily vulcanized at a temperature of 150° C. for 1 hour. After that, the core metal 24*a* is removed from the molding die to obtain the elastic layer 24*c* (hereinafter referred to as a roll-shaped molding product A).

Subsequently, as the adhesive layer 24*d*, a product produced by adding Ketjen black EC600-JD (trade name, manufactured by Lion Corp.) as a conductive carbon black to an addition cure-type silicone rubber adhesive (trade name: SE1819CV; "Liquid A" and "Liquid B" manufactured by Dow Corning Toray Co., Ltd. are mixed in equal amounts to make up 100 parts), and adjusting the volume resistance value to $10^9$ Ω·cm, is used, and is uniformly coated on the roll-shaped molding product A to a thickness of 5 μm (hereinafter, referred to as a roll-shaped molding product B).

The releasing layer 24*e* is produced into a tube shape having a thickness of 50 μm, and a mixture containing 0.5 parts of polyvinylidene fluoride (PVDF) and 0.5 parts of lithium trifluoromethanesulfonate (CF3SO3Li) relative to 100 parts of PFA (trade name: 451HP-J) manufactured by DuPont Company as the main binder, is used.

The fluorine resin tube, which is the above-described releasing layer 24*e*, is coated onto the roll-shaped molding product B, and then is subjected to heat curing at a temperature of 200° C. for 4 hours. After that, extra end portions are cut to obtain the pressure roller 24 according to this Example.

The fixing belt 23 including a base layer made of SUS material having a profile of Φ30 mm and a thickness of 30 μm, a silicone rubber elastic layer having a thickness of 250 μm, which is added by alumina filler, formed on the base layer, and a releasing layer formed on the silicone rubber elastic layer by coating PFA having a thickness of 15 μm on the silicone rubber elastic layer is used.

The base layer of the fixing belt 23 is grounded, and positive 600 V is applied to the core metal of the pressure roller.

(Electrostatic Offset Evaluation)

The electrostatic offset was evaluated by the following method. The electrostatic offset was evaluated by assembling the fixing device according to this Example to HP-Laser jet P4515 (A4 60 sheets/minute), which is a laser beam printer (LBP)), and continuously feeding 50 sheets of Neenah Bond 60 g/m2 paper, which were manufactured by Neenah Paper company, and were left under circumstances of low temperature and low humidity (15° C./10%), while a halftone image pattern was printed thereon. In addition, as the toner for use in this evaluation, the evaluation was performed by using negative toner having a property to be negatively charged. The evaluation is classified into the followings.

○): The electrostatic offset does not occur at all.

Δ: The electrostatic offset rarely, partially occurs.

X: The noticeable electrostatic offset occurs.

(Electric Potential Measurement)

At the above-described electrostatic offset evaluation, surface potential Vp of the pressure roller 24 and surface potential Vb of the fixing belt 23 were measured by a surface potential meter (Model 344) manufactured by TREK JAPAN company. The offset potential was obtained as a potential difference Vo=Vp−Vb. The potential difference Vo is positive, and as a value of the potential difference is large, the force to attract the toner to the recording material P is increased. Therefore, the potential is effective in the electrostatic offset, and it can be determined to be approximately equivalent to the level of the image. For the sake of convenience, the electrostatic offset is classified into three kinds, but it is judged that as the potential difference Vo is large, it is effective in the electrostatic offset.

(Toner Stain)

The toner stain was evaluated by using 75 g/m2 (trade name: X-9) manufactured by Boise Cascade company, of which calcium carbonate was a loading material. In the printing mode in which after 2 sheets of paper was fed by using the above-described LBP and the fixing device according to this Example, and then was left for 10 minutes under circumstances of low temperature and low humidity (15° C./10%), after 5000 sheets of paper was fed, the stain of the pressure roller was evaluated and then was classified into the followings.

⊙: The pressure roller is not stained.

○: The pressure roller is slightly stained, but the stain does not adhere to the paper.

X: The pressure roller is stained severely, and the stain adheres to the paper.

Example 2 to 4

Examples 2 to 4 are similar to Example 1, except that the contained amount of polyvinylidene fluoride (PVDF) relative to 100 parts of PFA, which is the main binder of the fluorine resin tube of the releasing layer 24*e*, is changed as indicated in Table 1.

Example 5 to 7

Examples 5 to 7 are similar to Example 1, except that the contained amount of lithium trifluoromethanesulfonate (CF3SO3Li) relative to 100 parts of PFA, which is the main binder of the fluorine resin tube of the releasing layer 24*e*, is changed as indicated in Table 1.

Example 8

Example 8 is similar to Example 1, except that a product produced by incorporating 0.5 parts of polyacrylonitrile (PAN) and 0.5 parts of lithium trifluoromethanesulfonate (CF3SO3Li) to 100 parts of PFA (trade name: 451HP-J) manufactured by DuPont Company as the main binder, is used for the fluorine resin tube of the releasing layer 24*e*.

Example 9

Example 9 is similar to Example 1, except that a product produced by incorporating 0.5 parts of polymethyl methacrylate (PMMA) and 0.5 parts of lithium trifluoromethanesulfonate (CF3SO3Li) to 100 parts of PFA (trade name: 451HP-J) manufactured by DuPont Company as the main binder, is used for the fluorine resin tube of the releasing layer 24*e*.

Example 10

Example 10 is similar to Example 1, except that a product produced by incorporating 0.5 parts of polyvinylidene fluoride (PVDF) and 0.5 parts of 1,1,2,2,3,3-hexafluoropropane-1,3-disulfonic acid dilithium salt (LiO3SCF2C F2CF2SO3Li) to 100 parts of PFA (trade name: 451HP-J) manufactured by DuPont Company as the main binder, is used for the fluorine resin tube of the releasing layer 24*e*.

Example 11

Example 11 is similar to Example 1, except that a product produced by incorporating 0.5 parts of polyvinylidene fluoride (PVDF) and 0.5 parts of cyclohexafluoropropane-1,3-bis (sulfonyl)imide potassium salt ($CF2(CF2SO2)_2NK$) to 100 parts of PFA (trade name: 451HP-J) manufactured by DuPont Company as the main binder, is used for the fluorine resin tube of the releasing layer 24*e*.

Example 12

Example 12 is similar to Example 1, except that a product produced by incorporating 0.5 parts of polyvinylidene fluoride (PVDF) and 0.5 parts of nonafluorobutanesulfonamide potassium salt (C4F9SO2NHK) to 100 parts of PFA (trade name: 451HP-J) manufactured by DuPont Company as the main binder, is used for the fluorine resin tube of the releasing layer 24*e*.

Example 13

Example 13 is similar to Example 1, except that a product produced by adding Ketjen black EC600-JD (trade name, manufactured by Lion Corp.) as a conductive carbon black, to an addition cure-type silicone rubber adhesive (trade name: SE1819CV; "Liquid A" and "Liquid B" manufactured by Dow Corning Toray Co., Ltd. are mixed in equal amounts to make up 100 parts), and adjusting the volume resistance value to $10^{11}$ Ω·cm, is used as the adhesive layer 24*d*.

Example 14

Example 14 is similar to Example 1, except that a product produced by adding lithium trifluoromethanesulfonate (CF3SO3Li) as a monomer electrolyte, to an addition cure-type silicone rubber adhesive (trade name: SE1819CV; "Liquid A" and "Liquid B" manufactured by Dow Corning Toray Co., Ltd. are mixed in equal amounts to make up 100 parts), and adjusting the volume resistance value to $10^{13}$ Ω·cm, is used as the adhesive layer 24*d*.

Example 15

Example 15 is similar to Example 1, except that a product produced by adding Ketjen black EC600-JD (trade name, manufactured by Lion Corp.) as a conductive carbon black and lithium trifluoromethanesulfonate (CF3SO3Li) as a monomer electrolyte, to an addition cure-type silicone rubber adhesive (trade name: SE1819CV; "Liquid A" and "Liquid B" manufactured by Dow Corning Toray Co., Ltd. are mixed in equal amounts to make up 100 parts), and adjusting the volume resistance value to $10^{12}$ Ω·cm, is used for the adhesive layer 24*d*.

Example 16

Example 16 is similar to Example 1, except that an addition cure-type silicone rubber adhesive (trade name: SE1819CV; "Liquid A" and "Liquid B" manufactured by Dow Corning Toray Co., Ltd. are mixed in equal amounts to make up 100 parts) is used as the adhesive layer 24*d*.

Example 17

Example 17 is similar to Example 1, except that a produce produced by mixing an addition cure-type liquid conductive silicone rubber material DY35-1439SC A&B (product having a volume resistance value of $10^6$ Ω·cm) and an addition cure-type liquid insulating silicone rubber material DY35-1349 A&B (the volume resistance value is $10^{14}$ Ω·cm or greater), both manufactured by Dow Corning Toray Co., Ltd., and adjusting the volume resistance value to $10^9$Ω·cm, is used as the elastic layer 24*c*.

Example 18

Example 18 is similar to Example 1 except that the pressure roller is not applied by the voltage and the core metal is grounded.

Example 19

Figure 2:
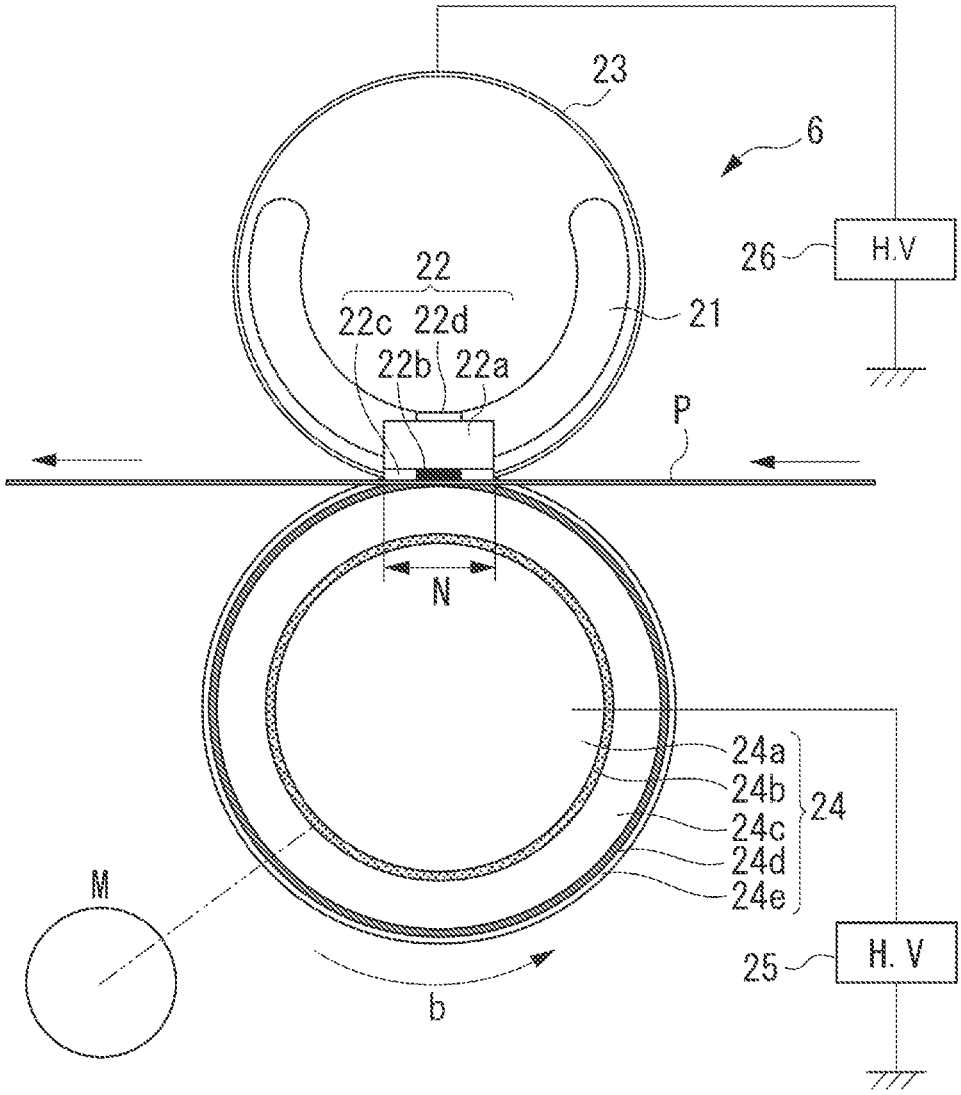
FIG. 2 is a diagram of Example 19.

As illustrated in FIG. 2, two voltage applying circuits 25 and 26 are provided to the heating fixing device 6, in which one applies a negative voltage of 400 V to the base layer of the fixing belt 23, while the other applies a positive voltage of 600 V to the core metal 24*a* of the pressure roller 24 similar to Example 1. In addition, the pressure roller 24 is similar to the one in Example 1.

Comparative Example 1

The elastic layer 24*c* uses one (product having volume resistivity of $10^6$ Ω·cm) similar to Example 1, and the adhesive layer 24*d* has only addition cure-type conductive silicone rubber adhesive (trade name: SE1819CV; 50 parts Liquid A and 50 parts Liquid B manufactured by Dow Corning Toray Co., Ltd. are mixed with together at a proportion of 1:1). The fluorine resin tube of the releasing layer 24*e* has only PFA (trade name: 451HP-J) manufactured by DuPont company as a main binder. The fixing belt 23 and the pressure roller 24 are grounded without applying the voltage thereto.

Comparative Example 2

Comparative Example 2 is similar to Comparative Example 1, except that a positive voltage of 600 V is applied to the core metal of the pressure roller 24.

Comparative Example 3

Comparative Example 3 has a configuration similar to Example 1, except that a product produced by incorporating 1.0 parts of lithium trifluoromethanesulfonate (CF3SO3Li) into 100 parts of PFA (trade name: 451HP-J) manufactured by DuPont Company as the main binder, is used for the fluorine resin tube of the releasing layer 24*e*.

Comparative Example 4

Comparative Example 4 is similar to Comparative Example 1, except that the fluorine resin tube of the releasing layer 24*e* has only low-resistant PFA (trade name: C-9068) manufactured by DuPont company.

Evaluations of Examples and Comparative Examples are summarized in Table 1.

TABLE 1

| | Releasing layer 24e | | | |
|---|---|---|---|---|
| | Material 1 | | Material 2 | |
| Example 1 | PVDF | 0.5 parts | $CF_3SO_3Li$ | 0.5 parts |
| Example 2 | PVDF | 0.01 parts | $CF_3SO_3Li$ | 0.5 parts |
| Example 3 | PVDF | 0.05 parts | $CF_3SO_3Li$ | 0.5 parts |
| Example 4 | PVDF | 5 parts | $CF_3SO_3Li$ | 0.5 parts |
| Example 5 | PVDF | 0.5 parts | $CF_3SO_3Li$ | 0.01 parts |
| Example 6 | PVDF | 0.5 parts | $CF_3SO_3Li$ | 0.05 parts |
| Example 7 | PVDF | 0.5 parts | $CF_3SO_3Li$ | 5 parts |
| Example 8 | PAN | 0.5 parts | $CF_3SO_3Li$ | 0.5 parts |
| Example 9 | PMMA | 0.5 parts | $CF_3SO_3Li$ | 0.5 parts |
| Example 10 | PVDF | 0.5 parts | $LiO_3SCF_2CF_2CF_2SO_3Li$ | 0.5 parts |
| Example 11 | PVDF | 0.5 parts | $CF_2(CF_2SO_2)_2NK$ | 0.5 parts |
| Example 12 | PVDF | 0.5 parts | $C_4F_9SO_2NHK$ | 0.5 parts |
| Example 13 | PVDF | 0.5 parts | $CF_3SO_3Li$ | 0.5 parts |
| Example 14 | PVDF | 0.5 parts | $CF_3SO_3Li$ | 0.5 parts |
| Example 15 | PVDF | 0.5 parts | $CF_3SO_3Li$ | 0.5 parts |
| Example 16 | PVDF | 0.5 parts | $CF_3SO_3Li$ | 0.5 parts |
| Example 17 | PVDF | 0.5 parts | $CF_3SO_3Li$ | 0.5 parts |
| Example 18 | PVDF | 0.5 parts | $CF_3SO_3Li$ | 0.5 parts |
| Example 19 | PVDF | 0.5 parts | $CF_3SO_3Li$ | 0.5 parts |
| Comparative Example 1 | None | — | None | — |
| Comparative Example 2 | None | — | None | — |
| Comparative Example 3 | None | — | $CF_3SO_3Li$ | 1.0 parts |
| Comparative Example 4 | Low resistance PFA tube (C9068) | | | |

TABLE 1-continued

| | Elastic layer | Adhesive layer 24d | |
|---|---|---|---|
| | resistance (Ω · cm) | Additive | Resistance (Ω · cm) |
| Example 1 | $10^6$ | Ketjen black | $10^9$ |
| Example 2 | $10^6$ | Ketjen black | $10^9$ |
| Example 3 | $10^6$ | Ketjen black | $10^9$ |
| Example 4 | $10^6$ | Ketjen black | $10^9$ |
| Example 5 | $10^6$ | Ketjen black | $10^9$ |
| Example 6 | $10^6$ | Ketjen black | $10^9$ |
| Example 7 | $10^6$ | Ketjen black | $10^9$ |
| Example 8 | $10^6$ | Ketjen black | $10^9$ |
| Example 9 | $10^6$ | Ketjen black | $10^9$ |
| Example 10 | $10^6$ | Ketjen black | $10^9$ |
| Example 11 | $10^6$ | Ketjen black | $10^9$ |
| Example 12 | $10^6$ | Ketjen black | $10^9$ |
| Example 13 | $10^6$ | Ketjen black | $10^{11}$ |
| Example 14 | $10^6$ | $CF_3SO_3Li$ | $10^{13}$ |
| Example 15 | $10^6$ | Ketjen black $CF_3SO_3Li$ | $10^{12}$ |
| Example 16 | $10^6$ | None | $>10^{14}$ |
| Example 17 | $10^9$ | Ketjen black | $10^9$ |
| Example 18 | $10^6$ | Ketjen black | $10^9$ |
| Example 19 | $10^6$ | Ketjen black | $10^9$ |
| Comparative Example 1 | $10^6$ | None | $>10^{14}$ |
| Comparative Example 2 | $10^6$ | None | $>10^{14}$ |
| Comparative Example 3 | $10^6$ | Ketjen black | $10^9$ |
| Comparative Example 4 | $10^6$ | None | $>10^{14}$ |

| | Voltage applied to fixing film | Voltage applied to pressure roller | Surface potential (V) Fixing belt Vb | Surface potential (V) Pressure roller Vp |
|---|---|---|---|---|
| Example 1 | 0 V | +600 V | 420 | 587 |
| Example 2 | 0 V | +600 V | 392 | 397 |
| Example 3 | 0 V | +600 V | 417 | 562 |
| Example 4 | 0 V | +600 V | 419 | 591 |
| Example 5 | 0 V | +600 V | 387 | 402 |
| Example 6 | 0 V | +600 V | 419 | 560 |
| Example 7 | 0 V | +600 V | 417 | 592 |
| Example 8 | 0 V | +600 V | 418 | 570 |
| Example 9 | 0 V | +600 V | 418 | 576 |
| Example 10 | 0 V | +600 V | 416 | 579 |
| Example 11 | 0 V | +600 V | 420 | 580 |
| Example 12 | 0 V | +600 V | 424 | 576 |
| Example 13 | 0 V | +600 V | 421 | 577 |
| Example 14 | 0 V | +600 V | 346 | 572 |
| Example 15 | 0 V | +600 V | 362 | 575 |
| Example 16 | 0 V | +600 V | 392 | 516 |
| Example 17 | 0 V | +600 V | 349 | 420 |
| Example 18 | 0 V | 0 V | 221 | 118 |
| Example 19 | −400 V | +600 V | −250 | 492 |

TABLE 1-continued

| | | | | |
|---|---|---|---|---|
| Comparative Example 1 | 0 V | 0 V | 116 | −170 |
| Comparative Example 2 | 0 V | +600 V | 121 | −156 |
| Comparative Example 3 | 0 V | +600 V | 113 | −161 |
| Comparative Example 4 | 0 V | 0 V | −15 | 10 |

| | Potential difference Vo of offset potential (Vp − Vb) | Electrostatic offset | Stain of pressure roller |
|---|---|---|---|
| Example 1 | 167 | ○ | ○ |
| Example 2 | 5 | ○ | ○ |
| Example 3 | 145 | ○ | ○ |
| Example 4 | 172 | ○ | ○ |
| Example 5 | 15 | ○ | ○ |
| Example 6 | 141 | ○ | ○ |
| Example 7 | 175 | ○ | ○ |
| Example 8 | 152 | ○ | ○ |
| Example 9 | 158 | ○ | ○ |
| Example 10 | 163 | ○ | ○ |
| Example 11 | 160 | ○ | ○ |
| Example 12 | 152 | ○ | ○ |
| Example 13 | 156 | ○ | ○ |
| Example 14 | 228 | ○ | ○ |
| Example 15 | 213 | ○ | ○ |
| Example 16 | 124 | ○ | ○ |
| Example 17 | 71 | ○ | ○ |
| Example 18 | −103 | Δ | ○ |
| Example 19 | 741 | ○ | ⊙ |
| Comparative Example 1 | −276 | X | ○ |
| Comparative Example 2 | −277 | X | ○ |
| Comparative Example 3 | −274 | X | ○ |
| Comparative Example 4 | 25 | ○ | X |

Electrostatic offset
○: Electrostatic offset does not occur at all.
Δ: Electrostatic offset very rarely occurs in some parts.
X Noticeable electrostatic offset occurs.
Stain of pressure roller
⊙: The stain does not occur at all.
○: Slight stain occurs in the pressure roller, but does not adhere to the paper.
X: The pressure roller is stained severely, and the stain adheres to the paper.

For Comparative Example 1 to Comparative Example 3, the stain of the pressure roller is good, but bad electrostatic offset occurs. This is caused by the fact in which it is not possible to suppress the releasing layer 24*e* of the pressure roller 24 from being negatively charged.

In addition, the resistance of the releasing layer 24*e* of the pressure roller 24 is decreased in Comparative Example 4. The electrostatic offset is good, but the pressure roller is significantly stained, so that the polluted toner is transferred to the paper.

For Example 1 to Example 7, the electrostatic offset and the stain of the pressure roller obtain good results. It will be understood that since the potential difference between the fixing belt 23 and the pressure roller 24 becomes positive, it has a good electrostatic offset from the viewpoint of electrical potential.

For Example 8 and Example 9, a satisfactory effect is obtained using polyacrylonitrile (PAN) and polymethyl methacrylate (PMMA), similarly to the case of using polyvinylidene fluoride (PVDF).

For Example 10 to Example 12, satisfactory results are also obtained using a disulfonic acid, a sulfonamide, or a sulfonamide, similarly to the case of using a sulfonic acid.

From Example 1, Example 13, and Example 16, it can be understood that if the adhesive layer 24*d* contains Ketien Black as conductive particle, as the volume resistance value is low, the potential difference Vo has a high value at a positive side.

In addition, as Example 14 and Example 15, it can be understood that if the adhesive layer 24*d* contains the monomer electrolyte as the charge control agent, even though the volume resistance value is high, the potential difference Vo has a high value at the positive side, it has a good electrostatic offset.

From Example 1 and Example 17, it can be understood that as the volume resistance value of the elastic layer 24*c* of the pressure roller is low, it has a good potential difference Vo. In the configuration of Example 17, it can obtain the good result from Comparative Examples 1 to 3.

From Example 18, it can be understood that the configuration, in which a voltage is not applied to the pressure roller 24, is effective in Comparative Examples 1 to 3. Although the potential difference Vo is determined as a negative side, the potential difference Vo of approximately 170 V is shifted to a positive side in Comparative Examples 1 to 3, and thus the level of the electrostatic offset is good.

From Example 19, it is possible to increase the potential difference Vo by applying a voltage to both the fixing belt 23 and the pressure roller 24 in the state in which there is no stain on the pressure roller. In addition, it is found that it is desirable to apply a voltage to any one of the heating member and the pressure roller in a direction to press the image on the recording material against the recording material.

The voltage value applied to the fixing belt 23 and the pressure roller 24 is not limited to Examples, but it can be appropriately set to increase the potential difference Vo between the fixing belt 23 and the pressure roller 24.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-015402 filed Jan. 27, 2011, which is hereby incorporated by reference herein in its entirety.

What is claimed is:

1. A pressure roller for use in a fixing device, the pressure roller comprising:

a core metal;

an elastic layer; and a releasing layer, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing:

at least one polymer selected from among polyvinylidene fluoride, polyacrylonitrile, and polymethyl methacrylate; and monomer electrolyte, wherein an amount of addition of the polymer to the fluorine resin is in the range of 0.05 parts to 5 parts relative to 100 parts of the fluorine resin.

2. The pressure roller according to claim 1, wherein the monomer electrolyte is a fluorinated surfactant.

3. The pressure roller according to claim 2, wherein the fluorinated surfactant is a fluoroalkylsulfonate acid derivative.

4. The pressure roller according to claim 3, wherein the fluoroalkylsulfonate acid derivative includes one of sulfonic acid, disulphonic acid, sulfonyl imide, and sulfonamide.

5. The pressure roller according to claim 1, wherein the elastic layer is conductive.

6. The pressure roller according to claim 1, further comprising an adhesive layer between the elastic layer and the releasing layer, the adhesive layer containing conductive particle.

7. The pressure roller according to claim 1, further comprising an adhesive layer between the elastic layer and the releasing layer, the adhesive layer containing monomer electrolyte.

8. The pressure roller according to claim 1, further comprising an adhesive layer between the elastic layer and the releasing layer, the adhesive layer containing conductive particle and monomer electrolyte.

9. The pressure roller according to claim 1, wherein the releasing layer is a tube.

10. A fixing device comprising:

a heating member; and a pressure roller including a core metal, an elastic layer, and a releasing layer, and forming, together with the heating member, a nip portion configured to heat, while pinching and transporting, a recording material carrying an image, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing:

at least one polymer selected from among polyvinylidene fluoride, polyacrylonitrile, and polymethyl methacrylate; and monomer electrolyte, wherein an amount of addition of the polymer to the fluorine resin is in the range of 0.05 parts to 5 parts relative to 100 parts of the fluorine resin.

11. The fixing device according to claim 10, further comprising a voltage applying member provided for at least one of the heating member and the pressure roller to apply a voltage to an image on the recording material in a direction to press the image against the recording material.

12. The pressure roller according to claim 3, wherein an amount of addition of the fluoroalkylsulfonic acid derivative to the fluorine resin is in the range of 0.05 parts to 5 parts relative to 100 parts of the fluorine resin.

13. The fixing device according to claim 10, wherein the monomer electrolyte is a fluorinated surfactant.

14. The fixing device according to claim 13, wherein the fluorinated surfactant is a fluoroalkylsulfonic acid derivative.

15. The fixing device according to claim 14, wherein the fluoroalkylsulfonic acid derivative includes one of sulfonic acid, disulphonic acid, sulfonyl imide, and sulfonamide.

16. The fixing device according to claim 10, wherein the elastic layer is conductive.

17. The fixing device according to claim 10, further comprising an adhesive layer between the elastic layer and the releasing layer, the adhesive layer containing a conductive particle.

18. The fixing device according to claim 10, further comprising an adhesive layer between the elastic layer and the releasing layer, the adhesive layer containing monomer electrolyte.

19. The fixing device according to claim 10, further comprising an adhesive layer between the elastic layer and the releasing layer, the adhesive layer containing a conductive particle and monomer electrolyte.

20. The fixing device according to claim 10, wherein the releasing layer is a tube.

21. The fixing device according to claim 14, wherein an amount of addition of the fluoroalkylsulfonic acid derivative to the fluorine resin is in the range of 0.05 parts to 5 parts relative to 100 parts of the fluorine resin.

22. A pressure roller for use in a fixing device, the pressure roller comprising:

a core metal;

an elastic layer;

a releasing layer; and an adhesive layer arranged between the elastic layer and the releasing layer, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing:

at least one polymer selected from among polyvinylidene fluoride, polyacrylonitrile, and polymethyl methacrylate; and monomer electrolyte, wherein the adhesive layer containing monomer electrolyte.

23. A pressure roller for use in a fixing device, the pressure roller comprising:

a core metal;

an elastic layer;

a releasing layer; and an adhesive layer arranged between the elastic layer and the releasing layer, wherein the releasing layer is made of at least one fluorine resin selected from among tetrafluoroethylene-perfluoroalkyl vinyl ether copolymer, ethylene-tetrafluoroethylene copolymer, and tetrafluoroethylene-hexafluoropropylene copolymer, the fluorine resin containing:

at least one polymer selected from among polyvinylidene fluoride, polyacrylonitrile, and polymethyl methacrylate; and monomer electrolyte, wherein the adhesive layer containing conductive particle and monomer electrolyte.

* * * * *